US005335810A

United States Patent [19]

Holloway

[11] Patent Number: 5,335,810

[45] Date of Patent: Aug. 9, 1994

[54] AIR ACTUATED FLOW CONTROL/LOAD BREAKER/GAS SEAL UNIT

[75] Inventor: Peter W. Holloway, London, England

[73] Assignee: Fleetwood Systems, Inc., Countryside, Ill.

[21] Appl. No.: 58,458

[22] Filed: May 6, 1993

[51] Int. Cl.[5] ..... G07F 11/04

[52] U.S. Cl. ..... 221/10; 221/64; 221/171; 221/278; 221/289; 221/298; 221/307; 221/308; 221/312 R; 193/32; 414/414

[58] Field of Search ..... 221/9, 10, 11, 12, 13, 221/14, 17, 64, 65, 66, 135, 151, 171, 278, 289, 298, 304, 307, 308, 296, 312 R; 414/403, 414; 193/32, 40, 25 R, 25 B; 222/214

[56] References Cited

U.S. PATENT DOCUMENTS 3,618,550 9/1971 Mojden et al. ..... 113/113 C
3,722,741 3/1973 Mojden ..... 221/11
4,410,103 10/1983 Fuhrmeister ..... 221/225 X
4,614,283 9/1986 Becker ..... 221/278

*Primary Examiner*—Robert P. Olszewski
*Assistant Examiner*—Dean A. Reichard
*Attorney, Agent, or Firm*—Trexler, Bushnell, Giangiorgi & Blackstone, Ltd.

[57] ABSTRACT

A control apparatus is provided for use in an article handling system having a conduit through which articles such as can ends in a facewise nested condition are conveyed from a first location to a second location. The control apparatus comprises a housing operatively interposed in the conduit and an elastomeric tubular sleeve member mounted in the housing and defining a through passage of a shape generally complementary to the shape of the articles. The tubular sleeve member is responsive to the level of pressure in a pressure chamber for applying a corresponding force about the periphery of the articles.

19 Claims, 3 Drawing Sheets

AIR ACTUATED FLOW CONTROL/LOAD BREAKER/GAS SEAL UNIT

BACKGROUND OF THE INVENTION

The present invention relates generally to apparatus for handling articles such as can ends or the like. More particularly, the invention concerns a novel and improved control apparatus for use with an article handling system for controlling or regulating the flow of articles in a desired fashion at various points in the system.

While the invention may find application in other article handling situations, the description will be facilitated hereinafter by specific reference to the problem of handling and processing can ends. The manufacture and handling of can ends has become a highly automated process, employing high speed manufacturing and handling apparatus and requiring rapid transfer of the articles or can ends from one work station to another. The manufacturing operation may include a number of machines which perform various fabrication, counting, and packaging steps on the can ends. Generally speaking, the can ends are carried in elongate conduits in a facewise nested condition between one work station in the system and the next.

The apparatus of the invention may also find use in can end handling operations attendant to the final end user. For example, the invention may be used with apparatus which accumulates a large number of stacks or sticks of can ends of a predetermined length or number and discharges these sticks of can ends as required into an infeed for a filling or canning operation. Such operations may at some points utilize various gases for sterilization and/or isolation of the product filling process from other components. For example, some liquid products are filled in a nitrogen atmosphere to substantially limit or eliminate oxygen inside of the can or other container. As will be more fully explained hereinbelow, the apparatus of the invention may advantageously be utilized as a gas seal unit in can end conduits feeding such a filling apparatus.

In addition to the foregoing gas seal application, the control apparatus of the invention may be used in a number of other applications wherein it is desired to control the flow of articles between one work station or location and the next. For example, in some applications it is desired to provide a so-called air gap or control gap at some point in the conduit. When the can ends or other articles back up in the conduit and fill this control gap or conversely, should the articles advance completely out of the air gap or control gap, a signal may be provided to indicate that the supply of articles at the control gap does not match the demand for articles downstream. One such air gap control system is shown for example in prior U.S. Pat. No. 3,618,550 which is commonly owned herewith.

In yet other applications, a relatively long, generally vertical column of articles or can ends may travel through a section of a conduit or be introduced into a conduit at some point in the system. In such instances, it may be desired to control the overall weight or pressure applied by such an elongated vertical column of articles or can ends. In a similar application, a relatively elongate vertical column of can ends is to be released from a rotary accumulator unit into a conduit upon receipt of a signal indicating a downstream demand for the articles or can ends. In this instance, it is desired to provide some further control of the velocity or speed of release of the articles from the elongate vertical column of articles into the receiving conduit. In particular, this latter application occurs in the case of the discharge end of a carousel-type rotary end feeder or accumulator unit of the type described for example in U.S. Pat. No. 3,722,741 which is commonly owned herewith.

OBJECTS OF THE INVENTION

Accordingly, it is a general object of the invention to provide a novel and improved air actuated apparatus which may be utilized as an air gap control, a load breaker or a gas seal unit, as well as in other flow control applications.

A related object of the invention is to provide a novel method of flow control and a novel method of gas sealing employing the apparatus of the invention.

BRIEF DESCRIPTION OF THE DRAWINGS

The features of the present invention which are believed to be novel are set forth with particularity in the appended claims. The organization and manner of operation of the invention, together with further objects and advantages thereof may best be understood by reference to the following description, taken in connection with the accompanying drawings in which like reference numerals identify like elements, and in which:

DETAILED DESCRIPTION OF THE PREFERRED EMBODIMENT

Figure 1:
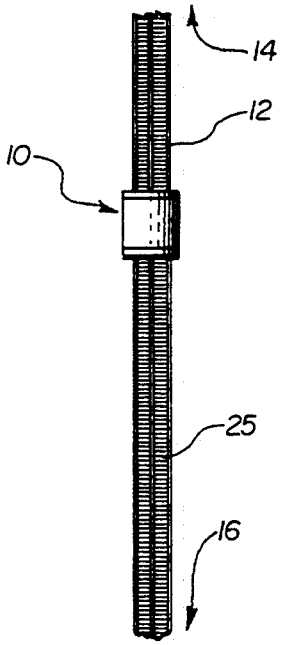
FIG. 1 is a somewhat diagrammatic view of an elongated article-carrying conduit, with which apparatus of the invention is employed.

Referring now to the drawings, the control apparatus of the invention may find utility in many applications. Four specific such applications are illustrated somewhat diagrammatically, respectively, in FIGS. 1–4. It will be understood that the apparatus of the invention may find utility in other applications as well, without departing from the invention. In the figures of drawings, the control apparatus of the invention is designated generally by the reference numeral 10 throughout.

In the application shown in FIG. 1, a generally vertically oriented elongate article-carrying conduit 12 carries articles such as can ends in a facewise nested condition from a first relatively higher location 14 to a second, relatively lower location 16. In such situations, it often occurs that the accumulated weight of can ends in the elongate conduit 12 exerts an excessive amount of pressure or force upon the equipment at or downstream of the lower end 16 of the conduit 12. As such, the flow control apparatus 10 of the invention is utilized as a "load breaker" device in this application. Briefly, the apparatus of the invention is interposed in the elongate conduit 12 for acting to break or generally slow down or retard the flow of articles past the location of the control apparatus 10. In effect, then, the pressure of the accumulated stack of nested articles in the conduit 12 above the control apparatus 10 is borne by the control apparatus 10, rather than by the downstream equipment, that is at or downstream of the lower end 16 of conduit 12. The load breaker or flow control apparatus 10 may be placed at any desired point along the conduit 12 to achieve the desired load relief or load breaking function.

Figure 2:
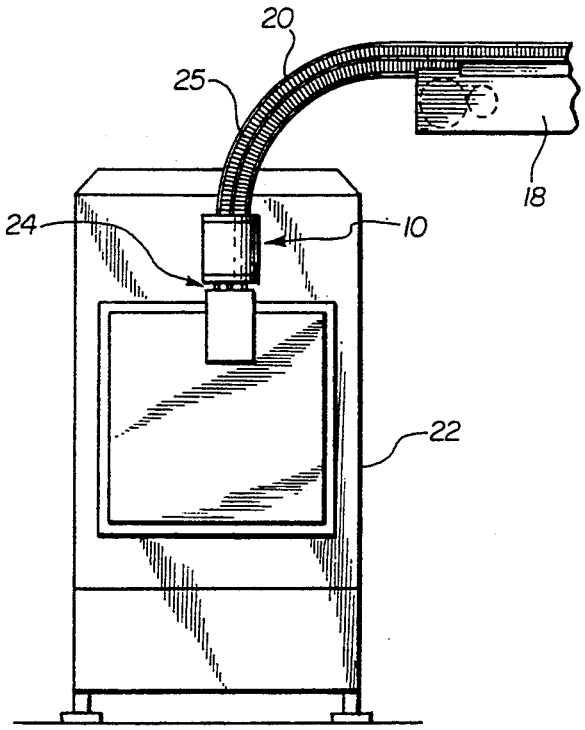
FIG. 2 is a diagrammatic view of an infeed to article fabrication apparatus employing apparatus according to the invention.
Figure 7:
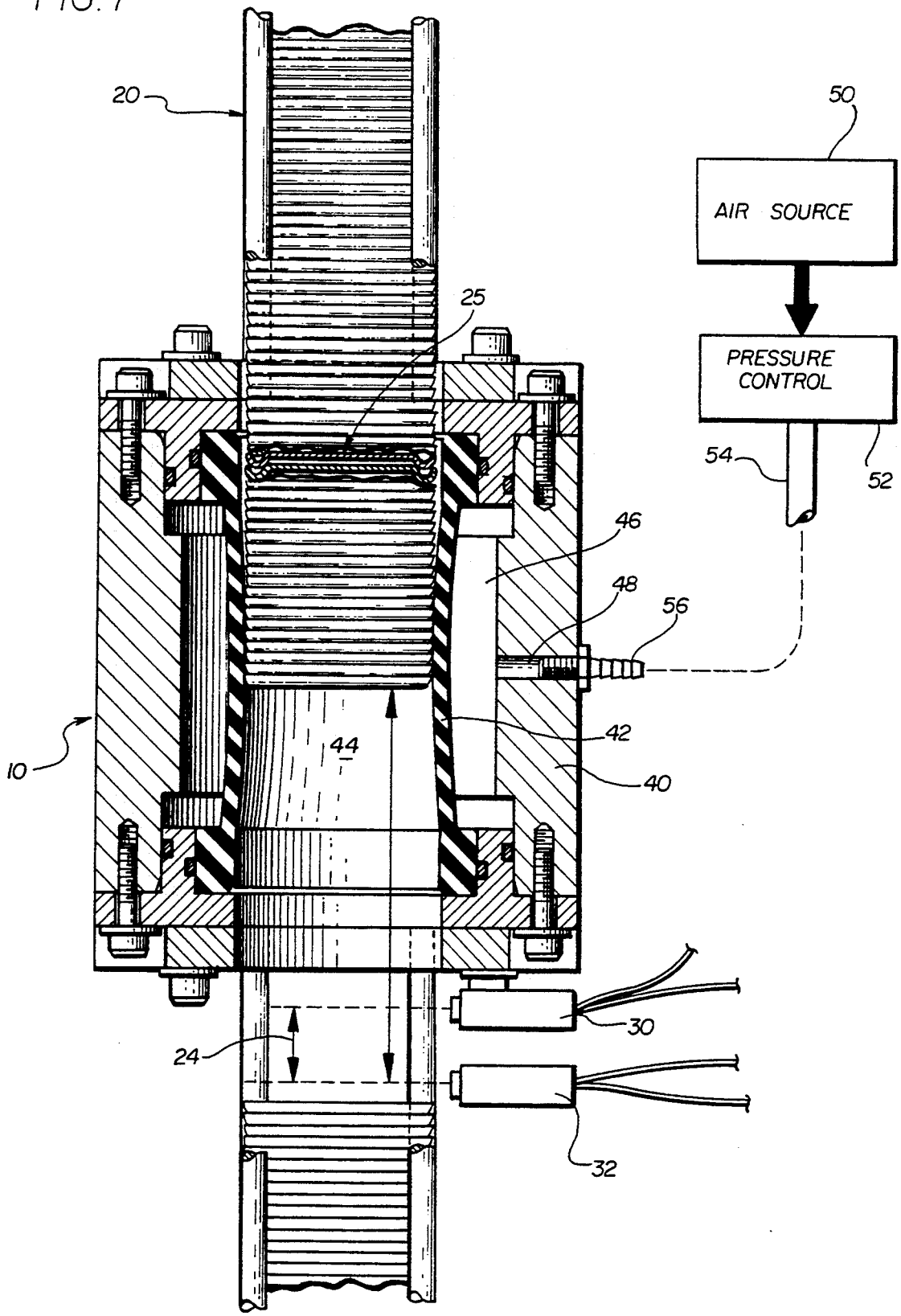
FIG. 7 is a view similar to FIG. 5 illustrating further details of the apparatus of the invention in connection with an air gap control unit of the type illustrated in FIG. 2.

Referring next to FIG. 2, the control apparatus 10 of the invention is utilized as an air gap control unit. Details of the apparatus of the invention as utilized in the application of FIG. 2 are shown in FIG. 7. The purpose and function of an air gap or control gap are generally as described in the above-referenced U.S. Pat. No. 3,618,550. In that patent, a mechanical, spring-loaded breaking device is utilized to retard or restrict the flow of can ends in a vertical portion of an end-carrying conduit. As described therein, the air gap or control gap is provided in order to provide a monitoring point for the flow of can ends between a first or upstream machine or piece of equipment and a second or downstream machine or piece of equipment which receives ends from the first machine by way of an interconnecting conveyor or conveyor means 18 and conduit 20, as also generally illustrated in FIG. 2 hereof, wherein the downstream machine or piece of equipment is designated generally by reference numeral 22.

As shown in FIG. 2 for purposes of illustration, the conveyor 18 comprises a belt-type of conveyor which generally feeds the ends in a flat, end-to-end condition. However, other conveyors or conduits may be provided without departing from the invention. Relevant to the air gap control, the conveyor 18 feeds the ends to further conduit 20 wherein the ends are carried in a facewise nested condition. An air gap control unit comprising a control apparatus 10 in accordance with the invention is interposed in the conduit 20 at a selected point prior to the junction thereof with the end feed point or area of the machine 22. An air gap or control gap 24 is provided at this point by action of the air gap control unit 10.

As more fully explained in the above-referenced U.S. Pat. No. 3,618,550, the operating and/or accelerating speeds of the upstream and downstream machines may vary, such that the rate of supply from the upstream machine may exceed the rate of demand of the downstream machine 22 or vice versa. In the first instance, an oversupply of can ends build up in the conduit 20, eventually causing the same to back up and fail to accept can ends from conveyor 18. Conversely, in the second situation, namely, an undersupply of ends to machine 22, the conduit 20 may develop a large gap or become completely empty, resulting in ends failing to stack properly in their facewise nested condition therein. As such, ends may fall through the conduit in an uncontrolled orientation causing the same to be fed in an improper orientation to machine 22 which can cause jamming or the like.

In order to obviate either of these situations of mismatch between respective supply of and demand for can ends, an air gap control unit 10 is utilized to establish a relatively narrow air gap or control gap 24 in the conduit 20, at a selected position ahead of the point where the conduit 20 feeds into the machine 22. Reference is next invited to FIG. 7 with respect to the details of the air gap control system illustrated diagrammatically in FIG. 2. Positioned at respective upper and lower ends of this air gap or control gap 24 and thus effectively defining the overall length thereof are respective sensors 30, 32. These sensors are in turn coupled with a suitable control unit (not shown) which is capable of adjusting the speed of operation of either the machine 22 or of an upstream machine (not shown) which feeds ends to the conveyor 18.

Thus, should the can ends 25 in the air gap 24 accumulate to a level above the level of the upper sensor 30, the control unit will respond to the signal from the sensor 30 by slowing down or momentarily stopping operation of the upstream machine, to slow down the supply of ends to the conduit 20. Conversely, should the supply of can ends 25 fall below the level of the lower sensor 32 in the air gap or control gap 24, the control unit will respond by slowing down operation of the downstream machine 22 until the level of can ends again builds up to above the level of the lower sensor 32. It will be recognized that it is also possible for the control system to have the opposite effect, that is to speed up the operation of the downstream machine 22 when the can ends reach the level of upper sensor 30 and speed up the supply from the upstream machine when the level of can ends falls below the level of sensor 32. However, it is assumed that the respective machines have a desired operating speed which normally is not be exceeded, such that slowing down or momentarily stopping the appropriate machine is generally preferable and more practical than speeding up one of the machines.

Figure 4:
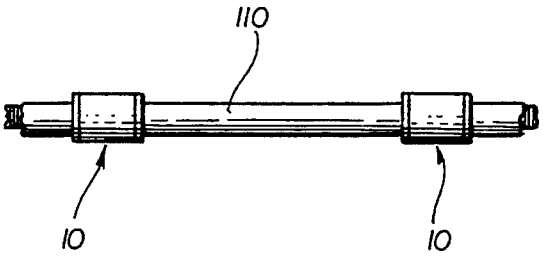
FIG. 4 is a diagrammatic view of a conduit employing apparatus of the invention as a gas seal.
Figure 5:
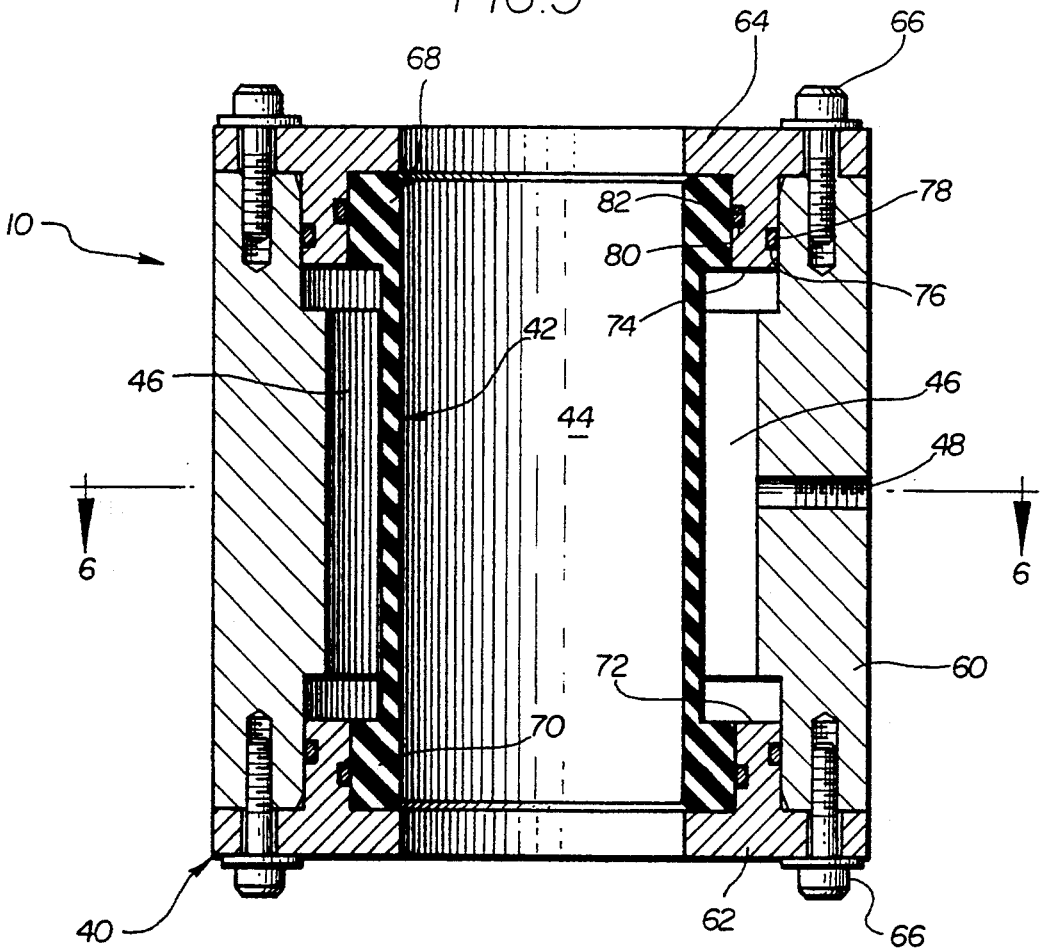
FIG. 5 is an enlarged sectional view of one embodiment of an apparatus according to the invention.
Figure 6:
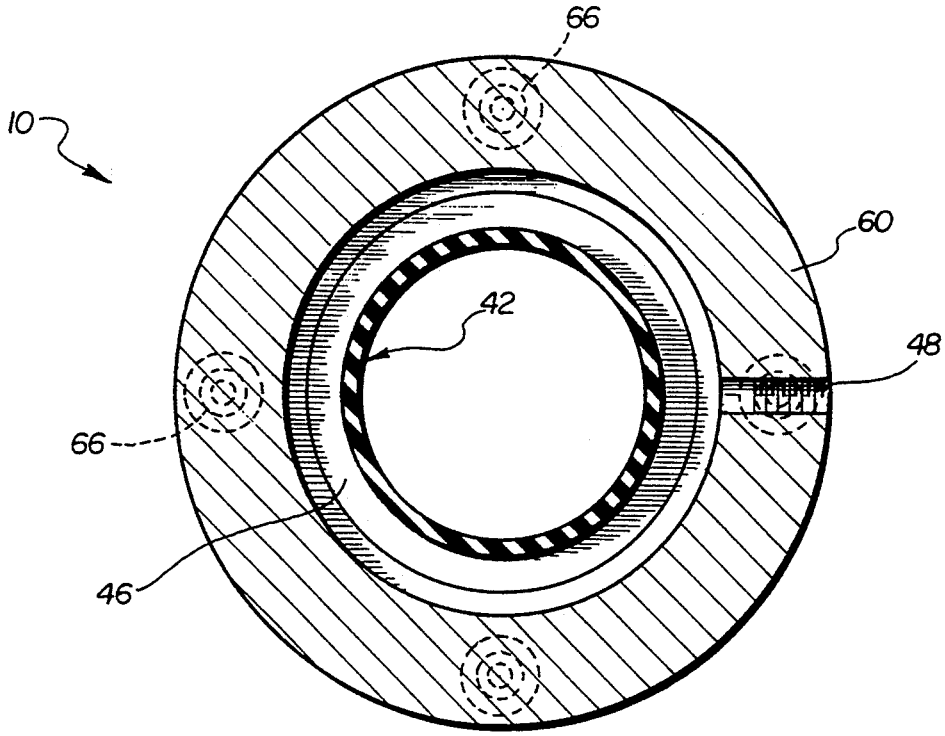
FIG. 6 is a sectional view taken generally along the line 6—6 of FIG. 5.

Further details of the control apparatus 10 of the invention for achieving the air gap 24 are illustrated in FIGS. 5 through 7, to which reference is next invited. As best viewed in FIGS. 5 and 7, the control apparatus 10 generally includes a housing 40 which is operatively interposed in the conduit in connection with which the apparatus of the invention is to be utilized, that is, in the applications illustrated and described above with reference to FIGS. 1 and 2, or in the applications illustrated in FIGS. 3 and 4 as will be more fully described later herein.

The housing 40 mounts an elastomeric tubular sleeve member 42 which in a relaxed state as illustrated in FIG. 5 generally defines a passage 44 through the housing 40. Moreover, the tubular sleeve 42 and the housing 40 define therebetween a generally annular space or pressure chamber 46. The housing 40 in the illustrated embodiment has a through opening 48 which communicates with the pressure chamber 46 for affording control of the pressure in the chamber 46. The tubular sleeve member 42 is generally sealingly engaged with the housing to thereby seal the pressure chamber 46, which in turn assures that pressure will be controlled through the opening 48 by a suitable source of pressurized air, suitable relief valves, and the like.

The tubular sleeve member 42 is responsive to the level of pressure in the pressure chamber 46 for applying a corresponding force about the periphery of articles (such as can ends) 25 within the passage 44. This pressure can be selected so as to retard or slow down the passage of articles through the passage 44 as desired, for example to form the air gap 24 as illustrated and described above with reference to FIG. 2, or to perform the load breaker function as illustrated and described above with reference to FIG. 1. This operation with respect to the retarding of the flow of can ends 25 is as best viewed in FIG. 7, wherein the elastomeric sleeve 42 is shown in an inwardly expanded condition in response to a somewhat increased pressure in the chamber 46. Thus, the pressure applied to the elastomeric sleeve 42 can be adjusted to compensate for the amount of axially directed force or pressure being applied to the ends 25, to achieve the desired amount of slowing down or breaking or resistance to the flow of the can ends 25. This slowing down may be so as to achieve the load breaking function of FIG. 1 or so as to develop and maintain the air gap 24 of FIG. 2. A suitable source of pressurized air 50 and a pressure control apparatus 52 may be utilized to control the pressure within the chamber 46 through the conduit or through opening 48, for example by coupling a suitable connecting conduit or tube 54 with a fitting 56.

Referring still to FIGS. 5–7, in the embodiment illustrated herein, the housing 40 generally comprises a cylindrical outer wall member 60 and a pair of similar, radially inwardly extending annular end members 62, 64 which are coupled to opposite axial ends of the cylindrical outer wall member 60. Suitable fasteners 66 may be utilized in this regard. The end members 62, 64 extend inwardly to engage the elastomeric tubular sleeve member 42 therebetween. The sleeve member 42 generally comprises a cylindrical, thin walled member of a resilient material such a rubber or rubber-like material having an outer diameter smaller than the inner diameter of the outer wall member 60 to thereby define the generally annular pressure chamber 46.

In the illustrated embodiment, axially opposite or outer ends 68, 70 of the sleeve 42 are of increased thickness, this increased thickness extending generally radially outwardly for engagement with the annular end members 62 and 64. Thus, the annular end members 62 and 64 serve to hold the outer wall 60 and the sleeve 42 together in assembled relation and thereby to define the pressure chamber 46 therebetween. Sealing of pressure chamber 46 is accomplished due to the resilient rubber-like nature of the sleeve 42 and its engagement with respective end pieces or members 62, 64.

Additional sealing may also be provided between the above-described parts of the apparatus 10, to further assure the desired sealing of pressure chamber 46, such that the pressure therein is controlled by the pressure control apparatus 52 as described hereinabove, by way of the through opening 48. This additional sealing means may take the form of respective radially inwardly extending, annular flange members or portions 72, 74 of the respective end pieces 62 and 64 which generally extend intermediate the enlarged end portions 68 and 70 of the tubular sleeve 42 and the inner surface of outer wall member 60. In order to further seal between the flanges 72, 74 and the outer wall member 60, respective annular recesses or grooves 76 are provided which mount elastomeric O-rings 78. In the illustrated embodiment, the recesses 76 are provided in the flange members 72, 74, however, these recesses may be provided in the facing inner surfaces of the outer wall member 60 without departing from the invention.

Similar annular grooves 80 and O-rings 82 may be additionally provided at the inwardly facing surfaces of flanges for sealing engagement against the enlarged end portions 68, 70 of the elastomeric tubular sleeve member 42.

Figure 3:
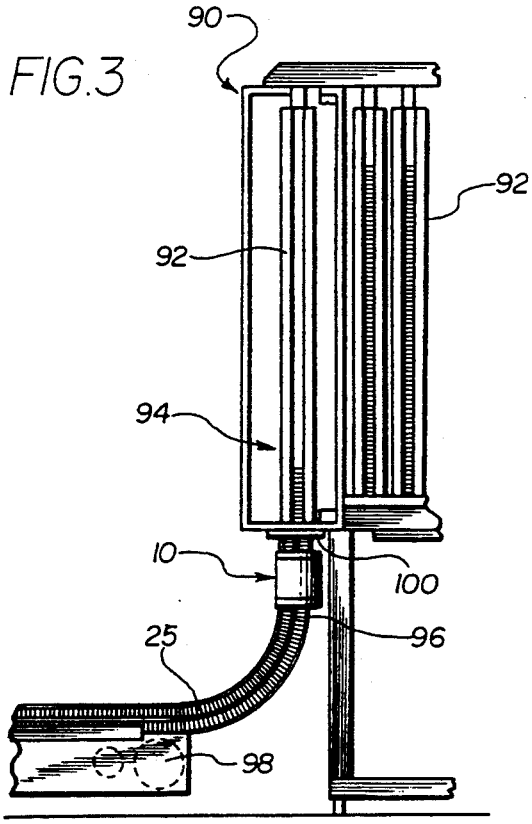
FIG. 3 is a partial diagrammatic view of a carousel-type rotary infeed unit employing apparatus according to the invention at its discharge portion.

Having thus described the structure of the control apparatus or device of the invention in accordance with the illustrated embodiment herein, reference is next invited to FIGS. 3 and 4 wherein two further applications of the control apparatus of the invention are illustrated. Referring first to FIG. 3, a control unit 10 of the invention is shown in connection with an outfeed portion of a rotary carousel-type infeed device or unit 90. This rotary infeed device 90 is generally of the type illustrated in the above-referenced U.S. Pat. No. 3,722,741.

Generally speaking, the device 90 has a plurality of elongate vertical pockets 92, each for holding a stack or stick of can ends in a facewise nested condition. These pockets 92 rotate about a generally oval track, in order to provide a relatively large supply or accumulation of can ends to be fed to downstream equipment. Generally speaking, the pockets 92 can be loaded with new can ends at one area, to one side of the device 90, preferably just beyond its outlet or discharge point or area 94 in the direction of rotation of the pockets 92. At the outlet or discharge area 94 one of the pockets 92 is brought into alignment with a conduit 96 for feeding the ends to downstream equipment. In the illustrated embodiment, a motorized end feeder 98 is diagrammatically illustrated for propelling the ends in a generally horizontal direction following their introduction from the pocket 92 to the conveyor 96.

In the rotary infeed device 90, the discharge is generally achieved by a release mechanism such as a retractable ledge or shelf-like member 100 which extends below and supports the can ends in the pocket 92 in the discharge or outfeed station or position 94. When this ledge or shelf 100 is retracted, the can ends fall by gravity into the conduit 96. However, should there be some empty extent of conduit 96, the can ends may fall some distance before encountering can ends in the conduit 96 and achieving the desired facewise stacked condition. In order to avoid tilting or other misorientation of the can ends 25 as they are released into the conduit 96, a flow control apparatus 10 in accordance with the invention is placed in the upper end of conduit 96, closely spaced below the discharge device or shelf 100 of the rotary infeed device 90.

The control apparatus 10 of the invention as utilized in FIG. 3 may act in similar fashion to the applications described hereinabove with reference to FIGS. 1 and 2, by retarding or slowing down the flow of the can ends somewhat as they are discharged from the pocket 92. For example, the ends will be discharged with some amount of force or pressure due to the vertical height and the consequent weight of the stack of ends in the pocket 92. This weight and the resultant acceleration can be partially borne and retarded or restrained somewhat by the action of the control device 10 of the invention, to provide a controlled feeding of the ends in a facewise stack condition into the conduit 96.

Referring now to FIG. 4, yet another application of the control apparatus 10 of the invention is as a gas seal device or unit in connection with a vacuum tube or conduit 110 for carrying can ends 25 as illustrated in FIG. 4. The conduit 110 comprises a closed, tubular or pipe-like conduit in order to maintain a vacuum or seal with respect to downstream filling equipment. As mentioned hereinabove, in some filling operations it is desired to fill containers in an atmosphere of relatively low oxygen. As such, an inert gas such as nitrogen is often utilized to prevent air from accumulating inside of the cans or containers during filling. In many products such as beverages and the like, accumulation of air within the container is undesirable. As such, some means must be provided to assure sealing of the filling line or area against the ingress of air, and to maintain the nitrogen or other inert gas in the filling area and minimize the escape thereof to the atmosphere, to assure efficient use of the nitrogen or other gas.

In the embodiment illustrated in FIG. 4, two of the control devices or apparatus 10 in accordance with the invention are interposed at spaced-apart points along the conduit 110. This conduit 110 carries can ends 25 in similar fashion to the other conduits described hereinabove with reference to FIGS. 1–3. Thus, the control apparatus or gas seal units 10 help to achieve a seal at two points along the conduit 110 by the action of their elastomeric tubular sleeves 42, under the influence of pressure in pressure chambers 46, being pressed into engagement with the outer peripheries of the can ends 25 as they pass through the respective passages 44 of the units 10. Thus, a seal is achieved at two points in the conduit 110 by the action of the elastomeric sleeves 42 surroundingly engaging the can ends 25 as they pass through the conduit 110. This force of engagement seals the conduit 110 sufficiently to discourage escape of the gas such as nitrogen therethrough or the ingress of air into the filling area, as desired.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The Invention is claimed as follows:

1. Flow control apparatus for use in an article handling system having a conduit through which articles such as can ends in a facewise nested condition are conveyed from a first location to a second location, said flow control apparatus being interposed in said conduit for controlling the flow of articles therethrough, and comprising: a housing operatively interposed in said conduit; an elastomeric tubular sleeve member mounted in said housing and defining a through passage of a shape generally complementary to the shape of said articles; means defining a pressure chamber; said tubular sleeve member being responsive to the level of pressure in said pressure chamber for applying a corresponding force about the periphery of said articles.

2. Apparatus according to claim 1 and further including a through opening in said housing communicating with said pressure chamber and control means operatively coupled with said through opening of said housing for controlling the pressure in said pressure chamber.

3. Apparatus according to claim 2 and further including level sensor means responsive to the level of articles in said conduit at a location downstream of said housing with respect to the direction of flow of articles through said conduit for producing a first control signal when said level is below a preselected level and a second control signal when the level is above a preselected level.

4. Apparatus according to claim 3, wherein said level sensor means comprise a pair of vertically spaced sensors defining a control gap therebetween.

5. Apparatus according to claim 1, and further including means for sealingly engaging said tubular sleeve member with said housing for defining said pressure chamber therebetween.

6. Apparatus according to claim 5, and further including control means for controllably varying the pressure in said pressure chamber.

7. Apparatus according to claim 1, wherein said housing comprises a generally cylindrical outer wall member and a pair of annular end members coupled to opposite ends of said outer wall member and extending radially inwardly thereof for engaging said tubular sleeve member therebetween.

8. Apparatus according to claim 7, wherein said tubular sleeve member comprises a generally cylindrical, thin walled member of a resilient material having an outer diameter smaller than an inner diameter of said outer wall member and having axially opposite end parts of increased thickness and extending radially outwardly for engagement with said annular end members to thereby define said pressure chamber between said tubular member and said outer wall member.

9. Apparatus according to claim 8, wherein each of said end members further includes an annular, axially inwardly projecting flange which extends between said outer wall member and one of said increased thickness parts of said tubular sleeve member.

10. Apparatus according to claim 9, and further including sealing means interposed between said flanges and said outer wall member.

11. Apparatus according to claim 10, and further including sealing means interposed between each of said flanges and said increased thickness parts of said tubular sleeve member.

12. Apparatus according to claim 11, wherein each said sealing means comprise annular recesses in each of said flanges and O-rings mounted in said annular recesses.

13. A gas seal apparatus for use in an elongate, article-carrying conduit through which articles such as can ends are conveyed in a facewise nested condition, said apparatus comprising a pair of gas seal units interposed at each of a pair of spaced apart locations along said conduit for maintaining a substantially gas-tight seal between portions of said conduit to either side of said gas seal units, at least one of said gas seal units comprising: a housing operatively interposed in said conduit; an elastomeric tubular sleeve member mounted in said housing and defining a through passage of a shape complementary to said articles; means defining a pressure chamber; said tubular sleeve member being responsive to the level of pressure in said pressure chamber for applying a corresponding force about the periphery of said articles as they pass through said passage for permitting articles to pass through said gas seal unit while maintaining substantially a seal between said tubular sleeve member and said articles, to thereby maintain a seal between the portions of said conduit to either side of said gas seal units as the articles are transported along said conduit and through said gas seal units.

14. A gas seal apparatus according to claim 13, and further including means communicating with said pressure chamber and control means coupled to said means communicating with said pressure chamber for controlling the pressure in said pressure chamber.

15. A gas seal apparatus according to claim 13, wherein said housing comprises a generally cylindrical outer wall member and a pair of annular end members coupled to opposite ends of said outer wall member and extending radially inwardly thereof for engaging said tubular sleeve member therebetween.

16. A gas seal apparatus according to claim 15, wherein said tubular sleeve member comprises a generally cylindrical, thin-walled member of a resilient material having an outer diameter smaller than an inner diameter of said outer wall member and having axially opposite end parts of increased thickness and extending radially outwardly for engagement with said end members to define said pressure chamber.

17. A method of controlling a flow of articles through a conduit in which articles such as can ends are conveyed in a generally facewise nested condition comprising: interposing in the conduit a flow control apparatus including an elastomeric tubular sleeve member responsive to a pressure applied thereto for applying a corresponding force about the periphery of said articles, and controlling the amount of pressure applied to said tubular sleeve member to thereby control the flow of articles past said tubular sleeve member, thereby controlling the flow of articles through said conduit.

18. A method of forming a gas seal for an elongate conduit through which articles such as can ends are conveyed in a generally facewise nested condition, comprising: interposing in the conduit first and second gas seal units at spaced apart locations along said conduit, at least one of said gas seal units comprising an elastomeric tubular sleeve member responsive to a pressure applied thereto for applying a corresponding force about the periphery of said articles, and controlling the pressure applied to the tubular sleeve member of each of said gas seal units for causing said tubular sleeve members to maintain substantially a gas seal between said tubular sleeve members and the articles passing therethrough while permitting the articles to flow through said tubular sleeve members, thereby maintaining substantially a gas seal between the portions of said conduit to either side of the gas seal units.

19. Sealing apparatus for use in an elongate, article-carrying conduit through which articles such as can ends are conveyed in a facewise nested condition, comprising: a gas seal unit interposed at each of a pair of spaced apart locations along said conduit for maintaining a substantially gas-tight seal between portions of said conduit to either side of said gas seal units; at least one of said gas seal units comprising a housing operatively interposed in said conduit, an elastomeric tubular sleeve member mounted in said housing and defining a through passage of a shape complementary to said articles; means defining a pressure chamber; said tubular sleeve member being responsive to the level of pressure in said pressure chamber for applying a corresponding force about the periphery of said articles as they pass through said passage for permitting articles to pass through said gas seal unit while maintaining substantially a seal between said tubular sleeve member and said articles, to thereby maintain a seal between the portions of said conduit to either side of said gas seal units as the articles are transported along said conduit and through said gas seal units.

* * * * *